US009700142B2

(12) United States Patent
Wagner

(10) Patent No.: US 9,700,142 B2
(45) Date of Patent: Jul. 11, 2017

(54) BACKREST OR SEATING ELEMENT

(71) Applicant: TOPSTAR GmbH, Langenneufnach (DE)

(72) Inventor: Peter Wagner, Neusäss (DE)

(73) Assignee: TOPSTAR GMBH, Langenneufnach (DE)

( * ) Notice: Subject to any disclaimer, the term of this patent is extended or adjusted under 35 U.S.C. 154(b) by 0 days.

(21) Appl. No.: 14/997,722

(22) Filed: Jan. 18, 2016

(65) Prior Publication Data

US 2016/0206105 A1 Jul. 21, 2016

(30) Foreign Application Priority Data

Jan. 16, 2015 (DE) ..... 10 2015 200 664

(51) Int. Cl.
*A47C 7/44* (2006.01)
*A47C 7/40* (2006.01)
*A47C 31/02* (2006.01)

(52) U.S. Cl.
CPC ..... *A47C 7/44* (2013.01); *A47C 7/40* (2013.01); *A47C 31/023* (2013.01)

(58) Field of Classification Search
CPC .. A47C 7/44; A47C 7/282; A47C 7/40; A47C 31/023
USPC ..... 297/452.56
See application file for complete search history.

(56) References Cited

U.S. PATENT DOCUMENTS

| | | | | |
|---|---|---|---|---|
| 3,572,817 A * | 3/1971 | Colautti | ..... | B60N 2/146 248/425 |
| 2005/0242652 A1* | 11/2005 | Kepler | ..... | A47C 7/14 297/452.56 |
| 2006/0001303 A1 | 1/2006 | Raftery | | |
| 2015/0173514 A1* | 6/2015 | Kikuchi | ..... | A47C 31/02 297/451.9 |

FOREIGN PATENT DOCUMENTS

| | | | | |
|---|---|---|---|---|
| CN | 203802056 U | 9/2014 | | |
| DE | 10012034 A1 * | 9/2001 | ..... | A47C 5/06 |
| DE | 202010000811 U1 | 6/2011 | | |
| DE | 202011002594 U1 | 7/2012 | | |
| DE | 202011107639 U1 | 1/2013 | | |
| EP | 2910147 A1 | 8/2015 | | |
| GB | 2394890 A | 5/2004 | | |
| GB | 2530297 A | 3/2016 | | |
| WO | 2011130264 A1 | 10/2011 | | |

OTHER PUBLICATIONS

British Examination Report for corresponding application GB1600712.2 ; Report dated Jul. 1, 2016.
British Examination Report for corresponding application GB1600712.2; Report dated Apr. 3, 2017.

* cited by examiner

*Primary Examiner* — Milton Nelson, Jr.
(74) *Attorney, Agent, or Firm* — Cantor Colburn LLP

(57) ABSTRACT

Back- or seat-element for a piece of seating furniture, in particular a swivel chair, including a flexible, tensible surface element and a support frame with a plurality of individual holding areas, the surface element is attached to and stretched therebetween.

9 Claims, 3 Drawing Sheets

BACKREST OR SEATING ELEMENT

CROSS REFERENCE TO RELATED APPLICATION

This application is related to and claims the benefit of German Patent Application Number 10 2015 200 664.6 filed on 16 Jan. 2015, the contents of which are herein incorporated by reference in their entirety.

The present invention refers to a back- or seat-element for a piece of seating furniture, as for example a swivel chair. Furthermore, the invention refers to a piece of seating furniture with a back- or seat-element and to a method for producing a back- or seat-element.

Different types of seating furniture with back- or seat-elements are known from the prior art. Upholstered seating furniture comprises generally a seat shell and a shell-shaped back-element, to which in each case cushion elements are arranged that are covered with fabric or leather. For example, the cover is attached to the seat- or back-element, respectively, and therefore fixes the cushion element between the cover and the shell. According to other known embodiments, a covered cushion element is attached to the shell, for example glued or fixed via separate fastening elements.

The disclosure provides a back- or seat-element for a piece of seating furniture which enables particularly comfortable seating and which is cost efficiently producible. Furthermore, the disclosure provides a cost effective method for producing a back- or seat-element for a piece of seating furniture.

This is achieved by a back- or seat-element, a piece of seating furniture and a method for producing a back- or seat-element as described herein.

The back- or seat-element according to the invention for a piece of seating furniture, in particular a chair, preferably a swivel chair, comprises a flexible, tensible surface element and a support frame with a plurality of individual holding areas, the surface element is attached to and stretched therebetween. A piece of seating furniture according to the invention comprises a back- or seat-element according to the invention. According to the method for producing a back- or seat-element for a piece of seating furniture, a flexible, tensible surface element is attached to a plurality of individual holding areas of a support frame and brought into a stretched state by shrinking afterwards. The surface element is stretched between at least three, preferably between four to seven, holding areas.

A basic idea of the invention is to hang a flexible surface element as for example a web structure, a fabric or a foil only at defined, individual holding areas or holding points of a support frame or a support structure, respectively. The holding areas stretch the surface element preferably in different directions (for example a longitudinal and a cross direction), so that the surface element as a whole is in a stretched state. A stretched state has to be in particular understood as form-defined state, in other words a state, the surface element comprises a defined form (in opposite to a "slack or un-stretched state").

The holding areas of the support frame preferably gear into appropriate tension areas of the surface element. Preferably, the tension areas are positioned in the peripheral area of the surface element. Between the individual tension areas, the surface element is not supported along its perimeter or along its outer edge, respectively, but exposedly stretched.

The separate and spaced apart holding areas which stretch the surface element provide a notably light and "airy" back- or seat-element which can be well ventilated and which has an appealing design.

One further basic idea of the invention is that the support frame is a stiff or stable, non-foldable element. Thus, the tension of the surface element is not caused by a dimensional change of the support frame but is preferably based on the surface element or on an impact on the surface element.

To stretch the surface element or to clamp the surface element onto the support frame it is preferred that the surface element comprises a shrinkable material, in particular, shrinkable by heat. In particular, the surface element is brought into the stretched state by a shrinking process, for example provided by heat influence on the surface element attached to the support frame. By way of example, the surface element can be clipped or differently attached to the support frame and then stretched by shrinking afterwards. In particular, the surface element can be shrunk onto the support frame. Shrinking of the shrinkable material stretches the surface element that is initially loose held at the holding areas.

According to a preferred embodiment of the invention, tension elements which extend along the surface element are provided for (further) stretching and/or for forming the surface element. The tension elements in particular extend along the edges and over the surface of the surface element, preferably between opposite edge areas of the surface element. For example, the tension elements can be formed by tension struts or bars which form or span the surface element—similar to the battens of a sail. Also reinforcing strips can be provided which extend along the edge areas or the outer edge of the surface element. The reinforcing strips can also be formed by struts or bars and they can make a contribution to the tension of the surface element, in particular along its outer edge. Alternatively, the reinforcing strips may be formed also by a material wise reinforcing of the surface element, for example by a web doubling. The tension struts and/or the reinforcing struts can be made up of plastics and are preferably elastically bendable.

To form a comfortable seat or a comfortable back, respectively, it is preferred that the tension elements stretch or form the surface element into a curved form. The tensions elements can in particular be received in appropriate tension- or bar-pockets, respectively, which extend along the surface element. The end portions of the tension struts are held in the pockets of the surface element. They form the tension element into a desired, predefined form.

Preferably, the surface element is pre-tensible and/or pre-formable by the tension elements, in particular independently of the support frame. Preferably, the surface element is not stretched first or only by the support frame, respectively, but by the tension elements. The tension elements are adapted to stretch and/or form the surface element even if it is not attached to the support frame. Preferably, the pre-stretched or pre-formed surface element has already a form-stability.

According to a further preferred embodiment of the invention, the surface element comprises holding pockets for receiving the holding areas of the support frame. The holding pockets which are preferably located in the periphery areas of the surface element are preferably opened towards the middle of the surface element and adapted for receiving holding areas which are strut-shaped or bar-shaped or pre-curved. Preferably, the holding pockets are initially mountable on the holding areas in a basic state of the surface element. Afterwards, the holding pockets are shrunk onto the holding areas so that the surface element is no longer non-destructively removable from the support frame. Thus, after shrinking (stretched state) the surface element is non-detachably or permanently, respectively, connected to the support frame.

Preferably, the surface element comprises a web structure or a web, respectively. This enables a particularly well ventilation. The surface element can be extendable or elastic, respectively. According to one embodiment, the surface element is a web spun from polyester fibers.

According to a preferred embodiment, the support frame comprises strut- or bar-like beams and/or projections (protrusions, swells, cantilever arms) whose ends form the holding areas. For example, the support frame can comprise a cross-like form with one or more longitudinal beams and one or more cross beams. In other words, axial end areas of holding beams form the holding areas of the surface element.

Preferably, the support frame comprises at least three and additionally preferably eight holding areas at maximum. For example, the surface element can be hold via three holding points located at the edges of a triangle and stretched therebetween. Alternatively, four or five holding points or suspension points or tension points are possible. According to an especially preferred embodiment, the support frame comprises six or eight holding areas which are pairwise and mirror symmetrically arranged relatively to each other in each case. The support frame can for example be made up of carbon (carbonate fibers, carbon fibers), wood or plastics.

Preferably, the support element is mostly freely stretched in front of the support frame and only hold on the individual holding points at the support frame. Preferably, the surface element lies only against the outer areas of the support frame, in particular against the outer edges of the beams or protrusions, respectively. In a middle or inner area, the surface element is preferably not supported. Preferably, the support frame supports the surface element punctually along its perimeter or stretches it, respectively.

A preferred embodiment according to the invention for producing the back or seat-element is described in the following: First, a dimensionally stable support frame with preferably at least three, in particular at least four or at least six cantilever beams or projections is provided whose end areas form holding areas for a flexible, tensible surface element. The surface element comprises holding pockets.

The holding pockets are placed on the holding areas of the support frame so that the surface element is hold on the support frame. However, it is still in an unstretched state or not yet in a fully stretched (end-) state, respectively. By the influence of heat, for example by a hot air gun, the surface element shrinks at least partly (in the area of the heat shrinkable material) which causes a stretching of the surface element. Afterwards, the surface element is firmly connected to the support frame and no longer non-destructively removable. The forming can be supported by tension elements or tension struts, respectively, which are provided on the surface element.

In the following, the invention is described based on preferred embodiments which are schematically shown in the enclosed figures.

Figure 3A:
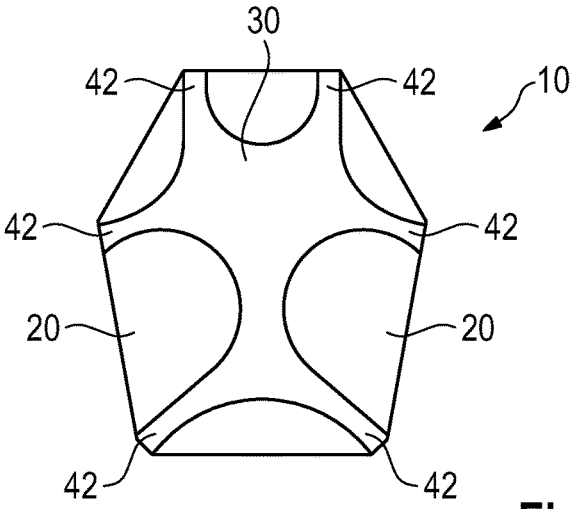
Figure 3B:
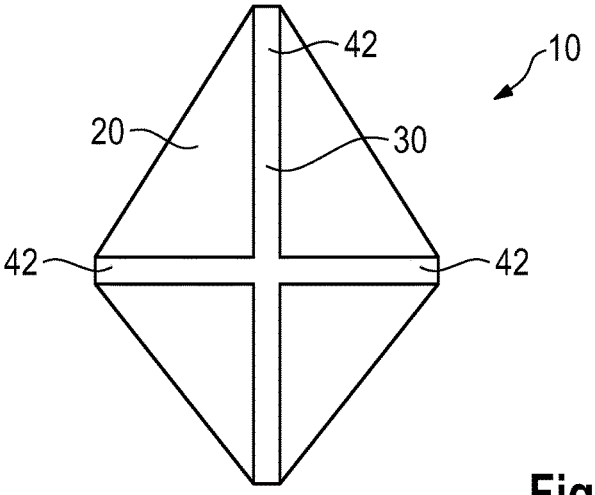
Figure 3C:
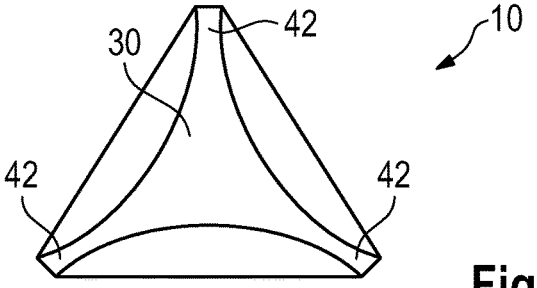

FIG. 3*a* to 3*c* show embodiments of a support frame according to the invention.

Equal or equally acting elements are in all figures identified by the same reference numerals.

Figure 1:
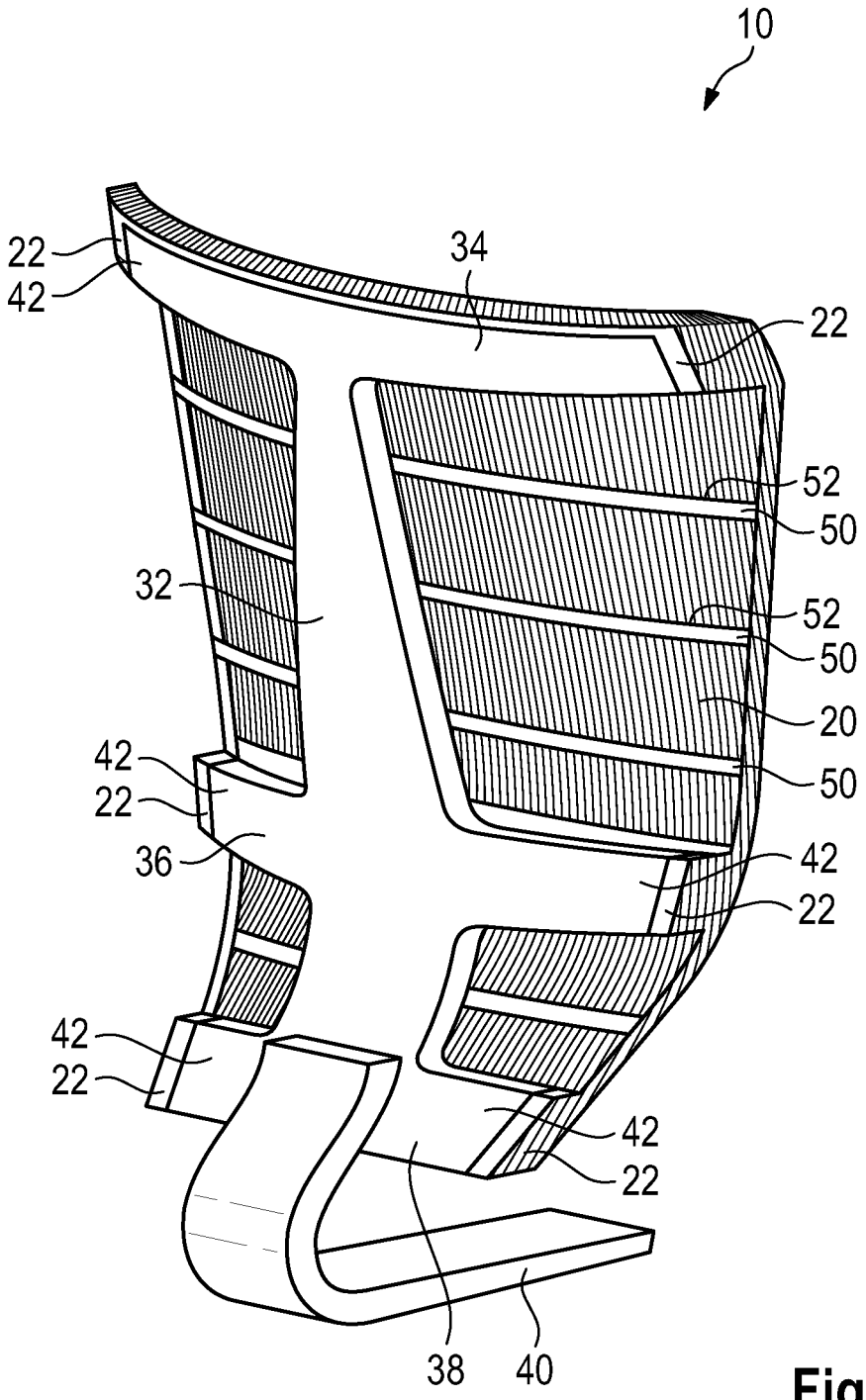
FIG. 1 shows at an angle a perspective back view of a back-element according to the invention.
Figure 2:
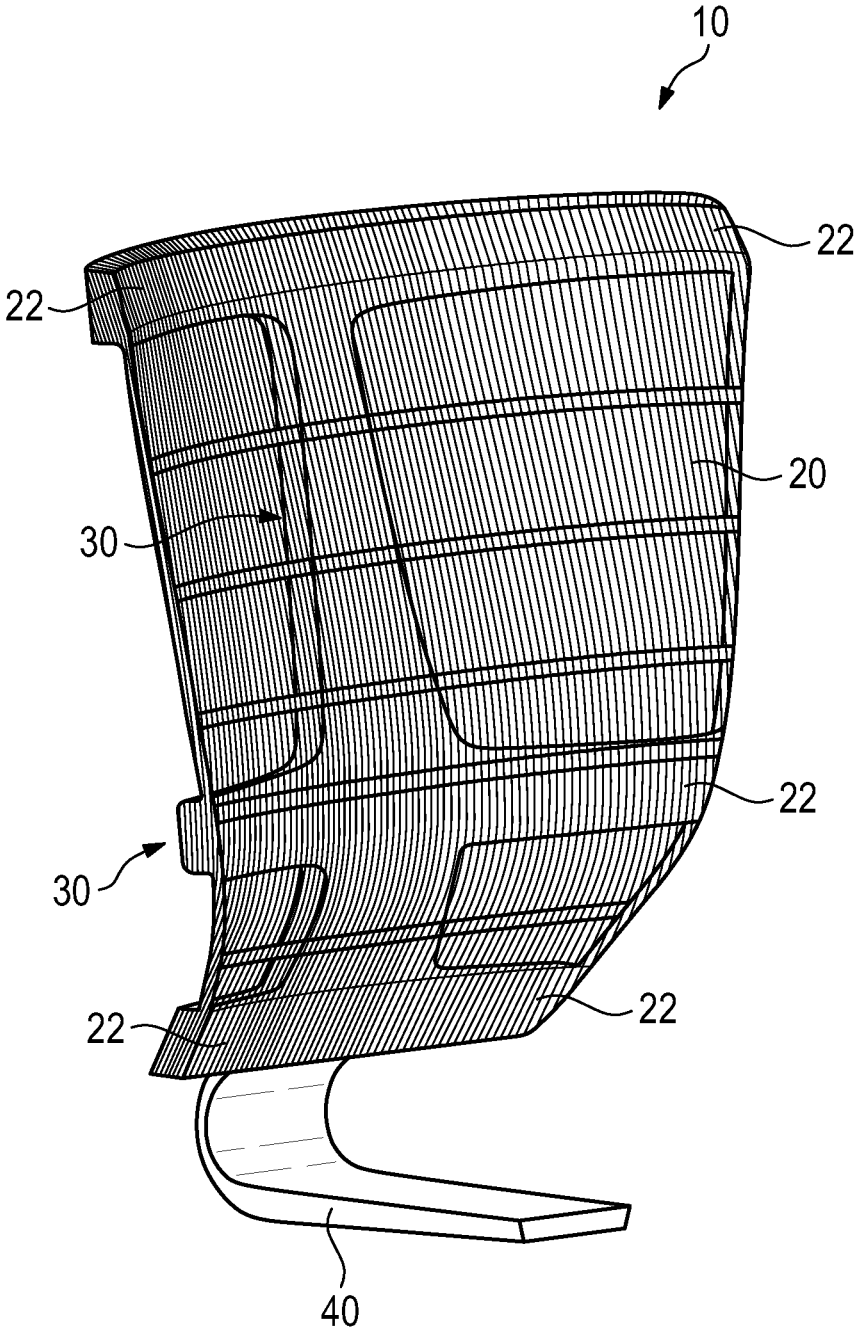
FIG. 2 shows at an angle a perspective front view of the back-element according to FIG. 1.

FIGS. 1 and 2 show a back-element 10 according to the invention which can be also called back. The back-element 10 is in particular designed to be arranged at a non-folding chair, for example a swivel chair. It comprises a support frame 30 which carries and stretches a flexible, tensible surface element 20. The support frame 30 is made up of one piece, for example of wood, plastics or carbon and comprises a longitudinal beam 32 extending along a horizontal direction and three cross beams 34, 36, 38 which extend transversely. The cross beams form cantilevers or protrusions of the support frame 30 whose end areas from holding areas 42. An upper cross beam 34 extends along an upper edge of surface element 20; a lower cross beam 38 extends along a lower edge of the surface element 20. A middle cross beam 36 extends approximately at a level of the lordosis. At the lower end of the support frame 30 a carrier arm 40 is provided to attach the back-element 10 at a seat-element or a basic frame of the chair, respectively.

The surface element 20 is formed web-like with a plurality of openings and comprises six holding pockets 22, which are put on the holding areas 42 of the support frame 30. End areas of the cross beams 34, 36, 38 are received in the holding pockets 22. The surface element 20 is brought by a plurality of preferably parallel extending tension elements 50 into a defined form. Overall, it has a curved form. The curvature extends along the tension elements 50 which are appropriately curved. The bending can be caused by the surface element 20. The tension elements 50 engage with their end portions and along their lengths into the surface element 20 and can for example be received and stretched between receiving pockets 52 which are provided for this purpose. After putting the holding pockets 22 onto the holding areas 42, the surface element 20 was shrunk, over the whole surface or area by area, in particular in the area of the holding pockets 22 by heat impact thereby being shrunk onto the support frame 30. At his, the surface element 20 is firmly attached to the support frame 30 and stretched.

FIGS. 3*a* to 3*c* schematically show further embodiments of a support frame 30 according to the invention. In FIG. 3*a* a support frame 30 with all together six holding areas 42 is shown. FIG. 3*b* shows a support frame 30 with four holding areas 42 and FIG. 3*c* shows a support frame 30 with three holding areas 42. Schematically, in each case a surface element 20 is indicated which is attached to the projections or holding areas 42, respectively, and stretched.

The embodiments are appropriately adaptable to a seat-element of a piece of seating furniture (seating surface).

All together the invention provides a cheaply producible, comfortable and stable back- or seat-element for a piece of seating furniture.

REFERENCE NUMERALS

10 back-element
20 surface element
22 holding pocket
30 support frame
32 longitudinal beam
34 first cross beam
36 second cross beam
38 third cross beam
40 carrier arm
42 holding area
50 tension element
52 receiving pocket

The invention claimed is:

1. Back- or seat-element for a piece of seating furniture, in particular a swivel chair, comprising a flexible, tensible surface element and a support frame with a plurality of individual holding areas, the surface element is attached to and stretched therebetween;

wherein the support frame is a stiff or stable, non-foldable element; and wherein the surface element comprises holding pockets for receiving the holding areas of the support frame, wherein the holding pockets are configured to be shrunk onto the holding areas so that the surface element is fixed to and non-removable from the support frame, wherein the surface element comprises shrinkable material, wherein tension elements are provided for stretching the surface element, and wherein the tension elements extend along the surface element.

2. Piece of seating furniture, comprising a back- or seat-element according to claim 1.

3. Method for producing a back- or seat-element for a piece of seating furniture, according to claim 1, wherein the flexible, tensible surface element is attached to the plurality of individual holding areas of the support frame and brought into a stretched state by shrinking afterwards.

4. Back- or seat-element according to claim 1, wherein, the tension elements stretch the surface element into a curved form.

5. Back- or seat-element according to claim 1, wherein, the surface element is pre-tensible and/or pre-formable by the tension elements independently from the support frame.

6. Back- or seat-element according to claim 1, wherein, the surface element is freely stretched in front of the support frame and only holds on the support frame via the holding areas.

7. Back- or seat-element according to claim 1, wherein, the surface element comprises a web structure.

8. Back- or seat-element according to claim 1, wherein, the support frame comprises struts or bars or projections whose ends form the holding areas.

9. Back- or seat-element according to claim 1, wherein, the support frame comprises at least three holding areas.

* * * * *